US009022173B2

(12) United States Patent
Singleton et al.

(10) Patent No.: US 9,022,173 B2
(45) Date of Patent: May 5, 2015

(54) GREASE GUIDE

(71) Applicant: L.B. Foster Rail Technologies, Inc., Burnaby (CA)

(72) Inventors: Steven D. Singleton, Sarver, PA (US); Thomas W. Urmson, Valencia, PA (US); Charles Henry Schnorr, III, Pittsburgh, PA (US); Ward T. Powell, Pittsburgh, PA (US); Charles A. Petrie, Warren, OH (US)

(73) Assignee: L.B. Foster Rail Technologies, Inc., Pittsburgh, PA (US)

( * ) Notice: Subject to any disclaimer, the term of this patent is extended or adjusted under 35 U.S.C. 154(b) by 0 days.

(21) Appl. No.: 13/935,019

(22) Filed: Jul. 3, 2013

(65) Prior Publication Data

US 2013/0341126 A1 Dec. 26, 2013

Related U.S. Application Data

(63) Continuation of application No. 12/034,871, filed on Feb. 21, 2008, now abandoned.

(60) Provisional application No. 60/902,538, filed on Feb. 21, 2007.

(51) Int. Cl.
*B61K 3/00* (2006.01)

(52) U.S. Cl.
CPC ..... *B61K 3/00* (2013.01)

(58) Field of Classification Search
CPC ..... B61K 3/00
USPC ..... 184/3.1, 3.2
See application file for complete search history.

(56) References Cited

U.S. PATENT DOCUMENTS

| | | | |
|---|---|---|---|
| 804,787 | A | 11/1905 | Young |
| 1,097,704 | A | 5/1914 | Cassidy et al. |
| 1,205,711 | A | 11/1916 | Clark |
| 1,546,778 | A | 7/1925 | De Niff |
| 1,630,584 | A | 5/1927 | Schneider |
| 1,669,603 | A | 5/1928 | Derrick |
| 1,728,412 | A | 9/1929 | Humphries |

(Continued)

FOREIGN PATENT DOCUMENTS

| | | | |
|---|---|---|---|
| DE | 814172 | C | 9/1951 |
| DE | 921946 | C | 1/1955 |

(Continued)

OTHER PUBLICATIONS

United Kingdom Search Report for U.S. Appl. No. 12/034,871 dated Jun. 19, 2008.

(Continued)

*Primary Examiner* — William E Dondero
*Assistant Examiner* — Robert T Reese
(74) *Attorney, Agent, or Firm* — Honigman Miller Schwartz and Cohn LLP

(57) ABSTRACT

A trough for use on wiping bar assembly of a rail lubrication system, wherein the wiping bar assembly includes a Manifold body and a flow passageway having an exit end at least partially defined in the manifold body. The trough includes a body having a first section and a second section extending away from the first section, wherein the first section of the body is positioned adjacent the exit end, and wherein a mat is provided within the trough.

28 Claims, 7 Drawing Sheets

(56) References Cited

U.S. PATENT DOCUMENTS

| | | | | |
|---|---|---|---|---|
| 1,745,213 | A | | 1/1930 | Gray |
| 1,803,923 | A | | 5/1931 | Allen |
| 1,878,259 | A | | 9/1932 | Bodkin |
| 1,939,846 | A | * | 12/1933 | Fenton ..... 428/17 |
| 1,940,527 | A | | 12/1933 | Bolt |
| 1,968,809 | A | * | 8/1934 | Curtis ..... 428/147 |
| 1,978,906 | A | | 10/1934 | Madison |
| 1,979,447 | A | | 11/1934 | Butcher |
| 2,018,402 | A | | 10/1935 | Humphries |
| 2,185,810 | A | | 1/1940 | Heidenthal |
| 2,262,852 | A | | 11/1941 | Martin |
| 2,272,774 | A | | 2/1942 | McGarry |
| 2,555,615 | A | | 6/1951 | Stern |
| 2,821,263 | A | | 1/1958 | Kerler |
| 2,980,942 | A | | 4/1961 | Dabney |
| 3,147,822 | A | | 9/1964 | Henry |
| 4,088,078 | A | | 5/1978 | Noble |
| 5,394,958 | A | | 3/1995 | Junk et al. |
| 5,641,037 | A | | 6/1997 | Wise et al. |
| 5,957,241 | A | | 9/1999 | Anderson |
| 5,972,470 | A | | 10/1999 | Engst |
| 6,010,268 | A | | 1/2000 | Sereg et al. |
| 6,401,867 | B1 | | 6/2002 | Michioka et al. |
| 6,475,594 | B2 | | 11/2002 | Johnston et al. |
| 6,742,624 | B2 | | 6/2004 | DiCarlo |
| 6,899,940 | B2 | | 5/2005 | Leriget |
| 6,971,479 | B1 | | 12/2005 | Urmson, Jr. et al. |
| 7,258,201 | B2 | | 8/2007 | Urmson, Jr. et al. |
| 7,273,131 | B2 | | 9/2007 | Urmson, Jr. et al. |
| 7,530,502 | B2 | | 5/2009 | Sherriff et al. |
| 2002/0056592 | A1 | | 5/2002 | Arens et al. |
| 2008/0047780 | A1 | | 2/2008 | Urmson et al. |
| 2008/0083584 | A1 | | 4/2008 | Urmson et al. |
| 2008/0223661 | A1 | | 9/2008 | Singleton et al. |
| 2009/0000869 | A1 | | 1/2009 | Holland |
| 2009/0000870 | A1 | | 1/2009 | Holland |

FOREIGN PATENT DOCUMENTS

| | | | |
|---|---|---|---|
| GB | 415174 | A | 8/1934 |
| GB | 2446949 | A | 8/2008 |
| JP | 2002037068 | A | 2/2002 |
| JP | 2002145062 | A | 5/2002 |
| WO | WO-8700566 | A1 | 1/1987 |
| WO | WO-03064233 | A1 | 8/2003 |

OTHER PUBLICATIONS

Office Action for U.S. Appl. No. 12/034,871 Dated Apr. 4, 2013.
Office Action for U.S. Appl. No. 12/034,871 Dated Feb. 15, 2012.
Office Action for U.S. Appl. No. 12/034,871 Dated Aug. 31, 2011.
Office Action for U.S. Appl. No. 12/034,871 Dated May 16, 2011.
Office Action for U.S. Appl. No. 12/034,871 Dated Sep. 15, 2010.
Office Action for U.S. Appl. No. 12/034,871 Dated Jan. 14, 2010.
Office Action for Australian Application No. 2010253819 dated Mar. 21, 2014.
Office Action for Canadian Application No. 2,622,561 dated Mar. 26, 2014.
Office Action for Chinese Application No. 2010800310493 dated Dec. 2, 2013 with English translation thereof.
Office Action for Chinese Application No. 2010800310493 dated Jul. 14, 2014 with English translation thereof.
European Search Report for Application No. 09815329.9 dated Dec. 5, 2013.
International Preliminary Report for Application No. PCT/US2009/057671.
International Search Report for Application No. PCT/US2009/057671.
International Search Report for Application No. PCT/US2010/036582.
Restriction Requirement for U.S. Appl. No. 12/788,971 dated Oct. 12, 2012.
Office Action for U.S. Appl. No. 12/788,971 dated Nov. 27, 2012.
Office Action for U.S. Appl. No. 12/788,971 dated Mar. 14, 2013.
Office Action for U.S. Appl. No. 12/788,971 dated Jun. 19, 2014.

* cited by examiner

GREASE GUIDE

CROSS REFERENCE TO RELATED APPLICATIONS

This application is a continuation application of U.S. Non-Provisional patent application Ser. No. 12/034,871 filed on Feb. 21, 2008, now abandoned, which claims the benefit of U.S. Provisional Patent Application No. 60/902,538, filed Feb. 21, 2007, which is hereby incorporated by reference.

BACKGROUND OF THE INVENTION

1. Field of the Invention

This invention relates to an apparatus for applying lubricant to a rail of a railroad track and, more particularly, to a lubricant distribution bar or wiping bar applicator for mounting on a railroad rail for application of lubricant thereto.

2. Description of the Prior Art

In the operation of railroads, it has long been the practice to apply lubricant or friction modifying materials onto railroad rails, such as to the top of the rails or sides of the rails at curves, turnouts, switches, and in some cases, the sections of the track immediately before a switch, and periodically spaced along the length of the track. Such lubricants and friction modifying materials, such as grease, can either reduce or increase the friction where necessary, to improve train performance and reduce wear on both the railroad rails and the train wheels. Reference may be made to U.S. Pat. Nos. 5,348,120 and 5,394,958 which are hereby incorporated by reference, for a dissertation on rail lubrication and disclosure of rail lubrication systems and applicator bars (oftentimes referred to as "wiping bars") used therein. Oftentimes with these rail lubrication systems, substantial amounts of lubricant is wasted by dripping or falling along the sides of the railroad rail thus reducing the efficiency of the lubricant transfer to the train wheels. In some prior art rail lubrication systems, a trough is typically used in conjunction with a wiping bar in order to catch the excess lubricant and to redistribute the lubricant back onto a flange of a train wheel as the wheel passes over the trough. These troughs, which are typically made of steel, fill up with grease forming a puddle thereon such that when a wheel flange passes over the trough, grease is transferred to the wheel flange. Oftentimes, the puddle of grease in the trough is splashed out when a deep wheel flange due to wearing of a train wheel passes over the trough thus reducing the effectiveness of the trough. Furthermore, because of these deep wheel flanges, the trough is typically positioned lower on the railroad rail to avoid damage to the trough from a deep wheel flange of a worn wheel passing thereon. However, because of the lower position of the trough, a normal wheel flange of a train Wheel either passes above the grease or barely contacts the grease in the trough such that the transfer of grease to a normal wheel flange becomes ineffective.

It is therefore desirable to overcome the above mentioned deficiency associated with a typical trough by providing a mat thereon for reducing the waste of lubricant and for increasing the efficiency of lubricant transfer to the railroad rails.

SUMMARY OF THE INVENTION

The present invention is directed to a trough for use on a wiping bar assembly of a rail lubrication system, wherein the wiping bar assembly includes a manifold body and a flow passageway having an exit end at least partially defined in the manifold body. The trough includes a body having a first section and a second section extending away from the first section, wherein the first section of the body is positioned adjacent the exit end, and wherein a mat is provided within the trough.

DESCRIPTION OF THE PREFERRED EMBODIMENT

Figure 1:
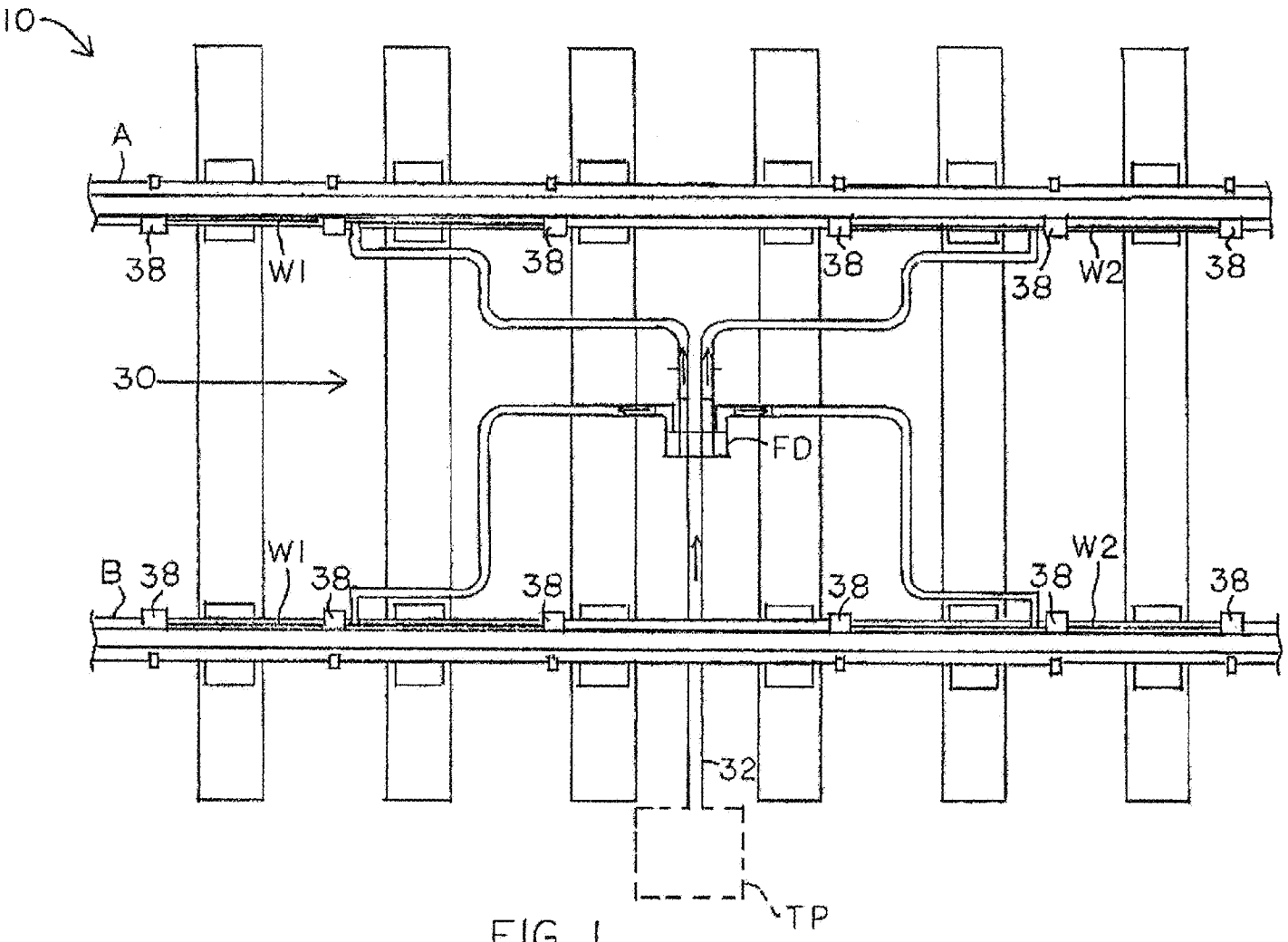
FIG. 1 is a plan view, partly diagrammatic, of a rail lubrication system having a trough and a mat made in accordance with the present invention.
Figure 2:
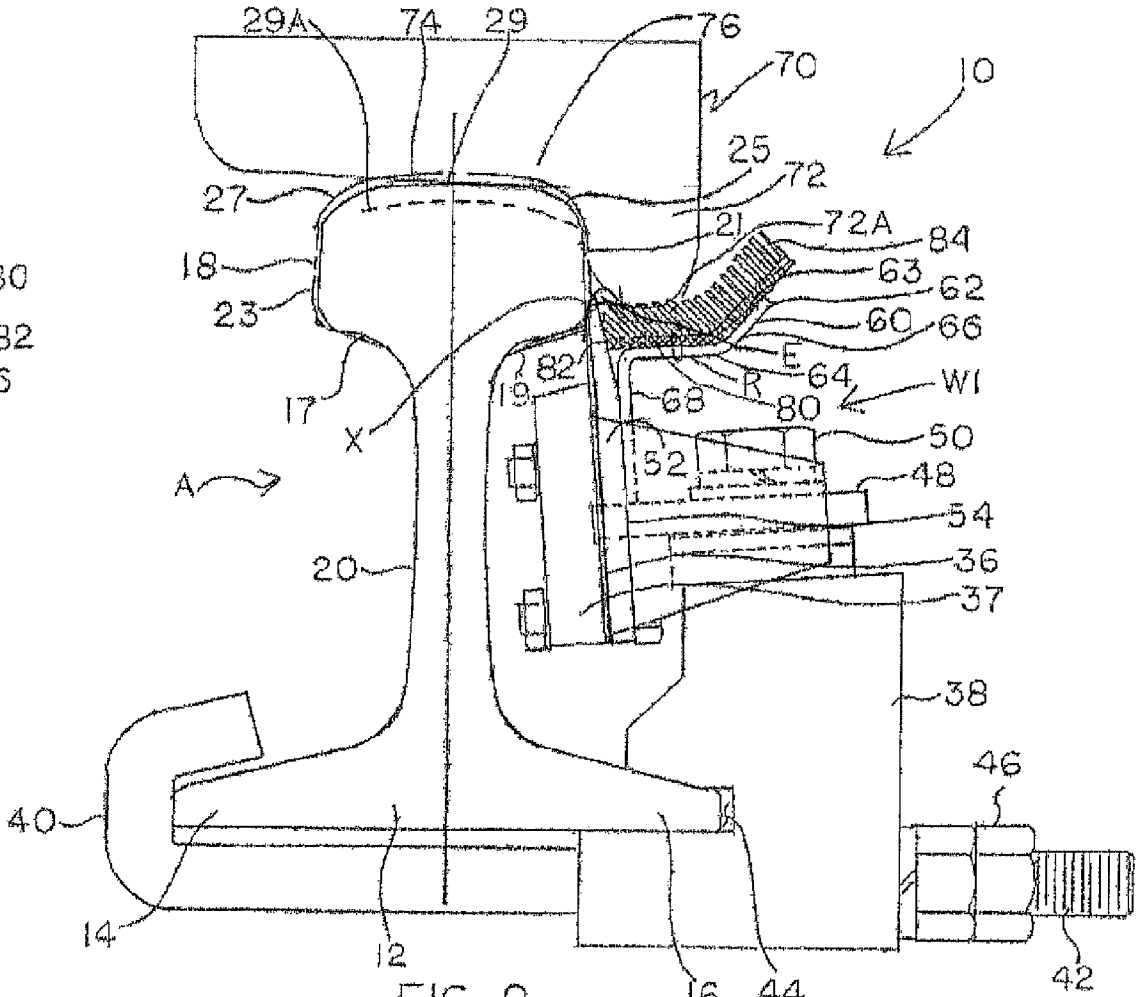
FIG. 2 is an end elevational view of a trough and mat of an applicator bar coacting with a railroad rail made in accordance with the present invention.

Referring to FIG. 1, the present invention provides for a rail lubrication system 10 that includes railroad rails A and B and wiping bar assemblies W1 and W2 secured thereto for applying friction modifying material to the railroad rails, Rail A and Rail B. The system 10 also includes a flow divider arrangement 30 in fluid communication with a lubricant tank containing a lubricant, such as grease, and a pump, via an inlet line 32. Such pump and tank arrangements are well known in the art and are designated as TP shown in phantom in FIG. 1. Referring to FIG. 2, Rail A, which is identical to Rail B, is a steel rail of usual cross-section and includes a base 12 having opposing flanges 14 and 16 extending therefrom. Rail A also includes a head 18 and a web 20 which secures the head 18 to the base 12. The head 18 has downwardly facing surfaces 17 and 19 on opposite sides of the web 20, generally vertical side surfaces or faces 21 and 23 (wherein side surface 21 is referred to as the "gage face") extending up from the downwardly facing surfaces 17 and 19, respectively, and curved surfaces 25 and 27 extending from the side surfaces 21 and 23 to a top surface 29 of the head 18. The curved surface 25 extending around from the gage face 21 to the top surface 29 is referred to as the "gage face corner."

Referring to FIGS. 1 and 2, the flow divider arrangement 30 includes a lubricant flow divider designated FD in fluid communication with wiping bar assemblies W1 and W2 for applying lubricant (such as grease, high viscosity oil or other types of rail lubricants) to the gage face 21 (and the gage face corner 25) of the head 18 of each railroad rail, Rail A and Rail B. As a train passes over Rail A and Rail B, lubrication is provided between a flange 72 of a train wheel 70 in order to reduce friction between the wheel flange 72 and the rail head 18 of each railroad rail, Rail A and Rail B. In one embodiment, the flow divider arrangement 30 comprises two wiping bar assemblies of this invention extending lengthwise of each of the two rails, Rail A and Rail B in tandem, one following the other, the first of the two being designated W1, the second W2. Each of these wiping bar assemblies W1 and W2 (four in all, two on Rail A directly across from two on Rail B, all four being identical) is mounted on an inside of the respective Rail A and Rail B for application of lubricant to the gage face 21 and gage face corner 25 of the respective rail head 18. Other arrangements may involve different numbers of wiping bar assemblies W (e.g., one or three or more assemblies per rail).

With continued reference to FIGS. 1 and 2, the wiping bar assemblies W1 and W2 being identical, a description of one of the assemblies W1 on Rail A will suffice for all. Thus, the wiping bar assembly W1 is shown mounted on an inside of Rail A using spaced apart mounting supports or clamps 38. Referring to FIG. 2, the wiping bar assembly W1 includes a thin or front blade 36 extending lengthwise on one face (the outside face) of an elongate lubricant manifold body 37, and an elongated distribution blade 52 extending lengthwise on the front blade 36. The distribution blade 52 is preferably made of metal such as steel. A flow passageway (not shown) is defined in at least a portion of both the manifold body 37 and the blade 52 for material to pass through, wherein the flow passageway defines an exit end E for depositing material onto the head 18 (particularly the gage face 21) of Rail A, similar to that disclosed in U.S. Pat. No. 5,394,958. The manifold body 37 and the blade 52 are mounted adjacent the web 20 of the Rail A (shown in FIG. 2) extending lengthwise of the rail between rail flange 16 of the base 12 and the downwardly extending surface 19 of the rail head 18. Each mounting clamp 38 includes a J-bolt 40 having a J-shaped end adapted to receive the flange 14 of base 12. Each J-bolt 40 includes a threaded end 42 that extends under the base 12 of Rail A and passes through the mounting clamp 38. The mounting clamp 38 also includes a recess 44 adapted to receive the flange 16. A fastener arrangement 46, such as nuts and a lockwasher, are received at the threaded end 42 for drawing the mounting clamp 38 together for tight securement (including lateral securement) of the wiping bar assembly W1 to Rail A. The manifold body 37, thin blade 36 and distribution blade 52, are secured to a wiping bar mounting body 48, wherein the mounting body 48 is fastened to an upper surface of the respective clamp 38 as indicated at 50.

Figure 3:
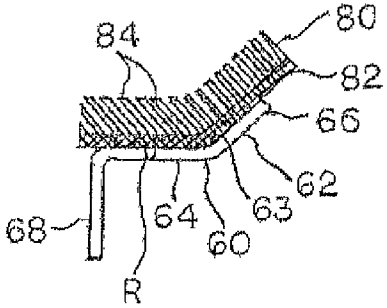
FIG. 3 is a side elevational view of the trough and mat of the applicator bar shown in FIG. 2.

Referring to both FIGS. 2 and 3; the wiping bar assembly W1 further includes an elongate trough 60 positioned adjacent the exit end E of the distribution blade 52 for catching the overflow of friction modifying material flowing from the blade 52 and from the head 18 of Rail A. The trough 60, which may be made by extrusion of a suitable polymeric Material or of metal, includes a body 62 having an inner surface 63 and defining a first section 64, a second section 66 extending upwardly away from the first section 64, and a downwardly extending flange 68 laterally extending from the first section 64. The flange 68 is used to secure the trough 60 to an outside face 54 of the distribution blade 52 such as by screws threaded in tapped holes in the wiping bar assembly W1 or by adhesive. The second section 66 of the body 62 is angled upward from the first section 64 such that excess material can flow back toward the exit end E and be redistributed onto the gage face 21 of Rail A. Alternatively, the first section 64 and the second section 66 of the body 62 of the trough 60 may be one flat horizontal member thus defining an L-shaped trough 60. Further, the first section 64 and the second section 66, which can be a flat member, may be angled or sloped upward with respect to the flange 68 such that lubricant flowing on either section 64, 66 of the trough body 62 may flow back toward the exit end E.

FIG. 2 illustrates in solid lines a wheel 70 of a railroad train (a railroad car or locomotive) riding on Rail A with the flange 72 of the wheel 70 on the inside of the rail head 18 (on the gage face 21 of the rail head 18) before any wearing down of the top surface 29 of the rail head 18 and/or wearing away of the tread of the wheel 70 and resultant prolongation of the wheel flange 72. The tread of the wheel 70 bearing down on the top surface 29 of the rail head 18 is indicated at 74. At 76 is indicated the curved transition (which extends in a circle around the wheel 70) from the flange 72 to the tread 74 which engages the gage face corner 25 of the rail head 18. The dotted lines, indicated generally at 72A, illustrate how the wheel flange 72 of a worn wheel passes in close proximity with the outside face 54 of the blade 52. The wearing away of the wheel tread 74 causes the wheel 70 to have a deeper flange 72A which may come in close proximity to the inner surface 63 of the body 62 of the trough 60. In prior art wiping bar assemblies which do not include a mat 80 provided within the trough 60 (as discussed below), a deep wheel flange 72A will cause excess splashing of the lubricant out of a trough thereby defeating its purpose (i.e., to reduce lubricant waste). The present invention permits a lower mounting of the blade 52 and front blade 36 over the prior art while believed to exceed the prior arts' lubricant transfer to the wheels.

Figure 4:
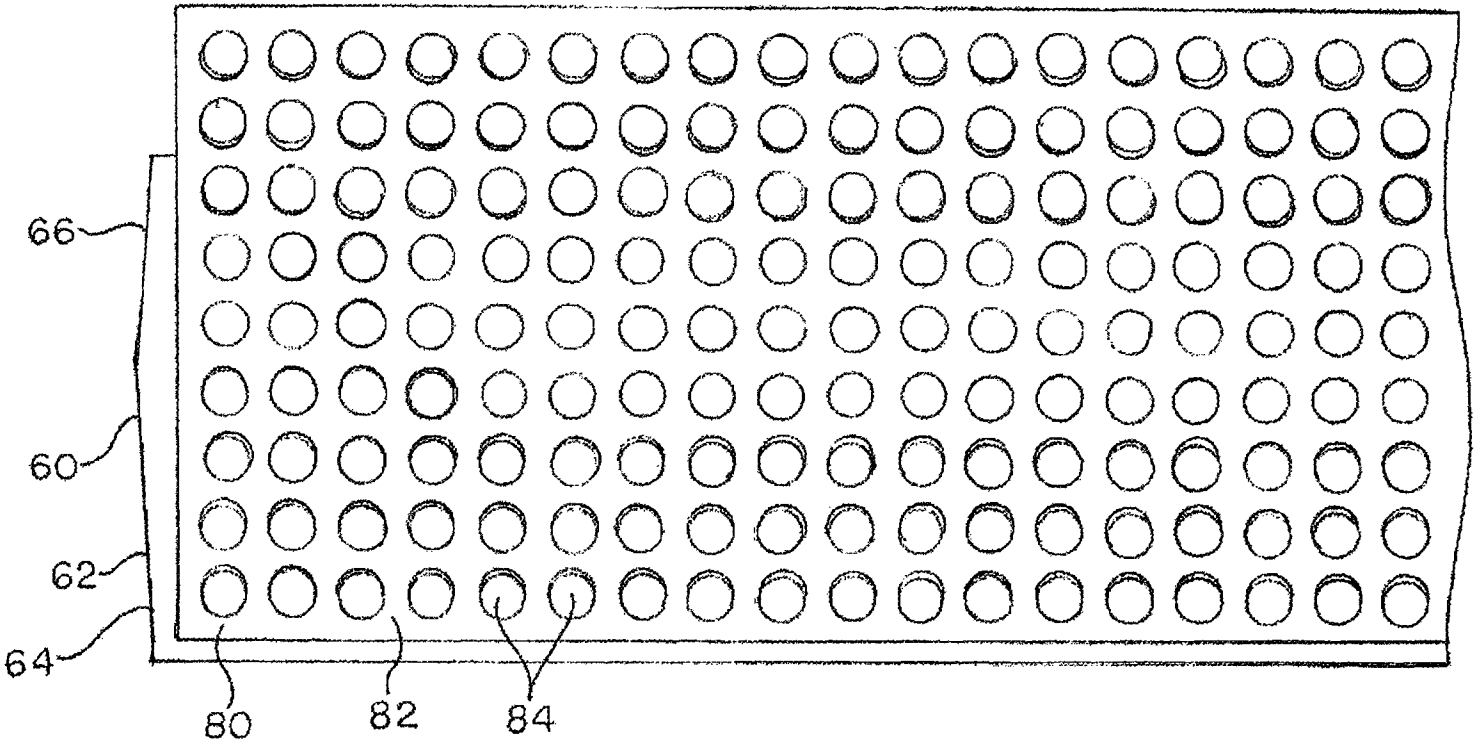
FIG. 4 is a top perspective view of the trough shown in FIG. 3.

With continued reference to FIGS. 2 and 3, a mat or pad 80 is secured to the inner surface 63 of the body 62 of the trough 60. The trough 60 is positioned adjacent the exit end E such that the mat 80 contacts the wheel flange 72. The excess friction modifying material flowing on the trough 60 is absorbed or collected by the mat 80 for redepositing on the wheel flange 72. The mat 80 acts as a liner in the trough 60 to increase the efficiency of the lubricant transfer to the railroad wheel 70. The mat 80 may be secured to the trough 60 via fasteners such as rivets R (one shown) or other adhering arrangements, such as hook and loop fasteners (i.e., Velcro®) or adhesives. The mat 80 substantially conforms to the angle of the first section 64 and the second section 66 when attached to the body 62 of the trough 60. In one embodiment shown in FIGS. 3 and 4, the mat 80 includes a base or backing 82 and a plurality of longitudinally extending fingers 84 axially extending from the base 82. The fingers 84 are adapted to coact with the wheel flange 72 for redepositing material thereon. The base 82 prevents the lubricant material from seeping through. The base 82 and the fingers 84 of mat 80 may be integrally formed from a unitary piece of elastomeric material such as rubber. Optionally, the mat 80 may have sealed ends (not shown) for preventing the lubricant from flowing off the ends of the trough 60. One type of mat material is manufactured by Superior Manufacturing Group under the trademark RUBBER BRUSH. Alternatively, the rubber mat fingers 84 can be replaced by rubber-type bristles or other types of bristle material (not shown).

Figure 4A:
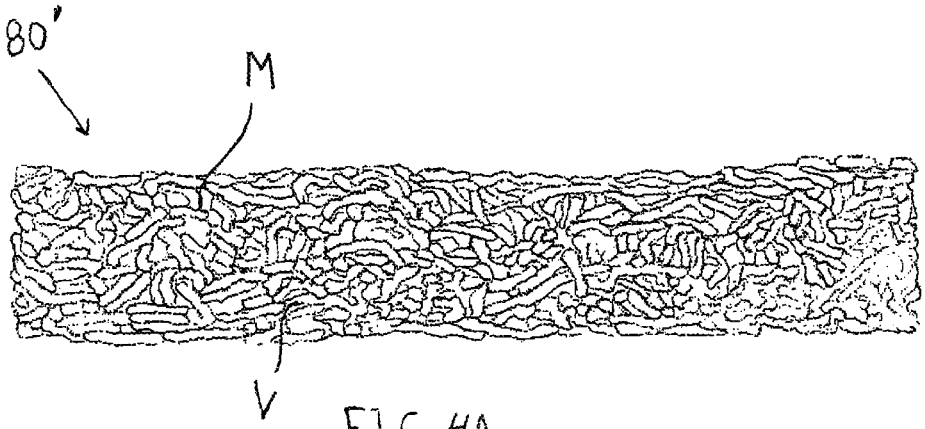
FIG. 4A is a side elevational view of another embodiment of a mat made in accordance with the present invention.

FIG. 4A shows a vinyl loop mesh material M that may be used for a mat 80'. The mesh material M includes a plurality of non-uniform loops intertwined together thus forming voids V therein. The mesh material M, which may be made of a resilient polymeric material, is often referred to in the industry as spaghetti ribbon and is made available by Sano Sports International.

In operation, friction modifying material passes adjacent the blade 52 onto the gage face 21. Excess lubricant material then flows into the trough GO as designated by arrow X shown in FIG. 2. The mat 80 collects some of the excess material on the fingers 84 and redeposits the material back onto the wheel flange 72 as the train wheel 70 passes thereon. Excess material falling on the base 82 can then flow toward the exit end E and be redeposited back onto the gage face 21 of the rail bead 18. When the mat 80' is used, the vinyl loop mesh material M of the mat 80' absorbs the lubricant material within the voids V. As the train wheel 70 passes over the mat 80', the mesh material M deforms and redeposits the absorbed lubricant material back onto the wheel flange 72. The mesh material M retains its shape after the wheel flange 72 passes thereon.

Figure 7:
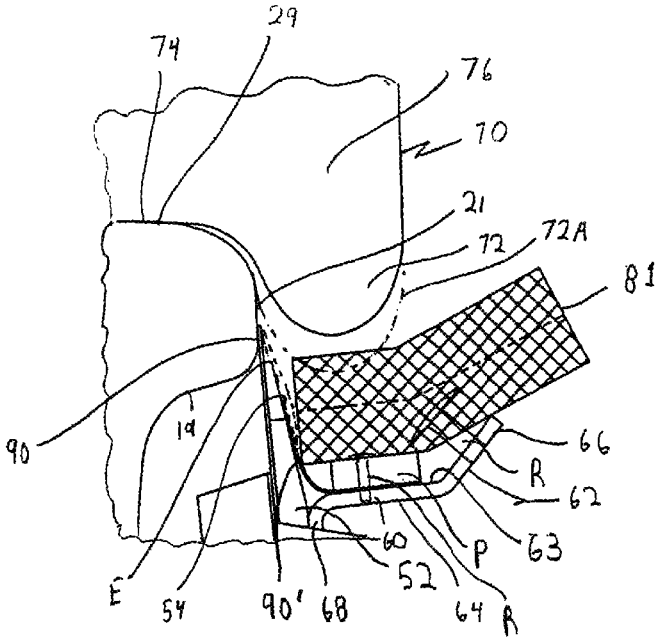
FIG. 7 is a partial end elevational view of a third embodiment of a trough and mat of an applicator bar coacting with a railroad rail made in accordance with the present invention.
Figure 5:
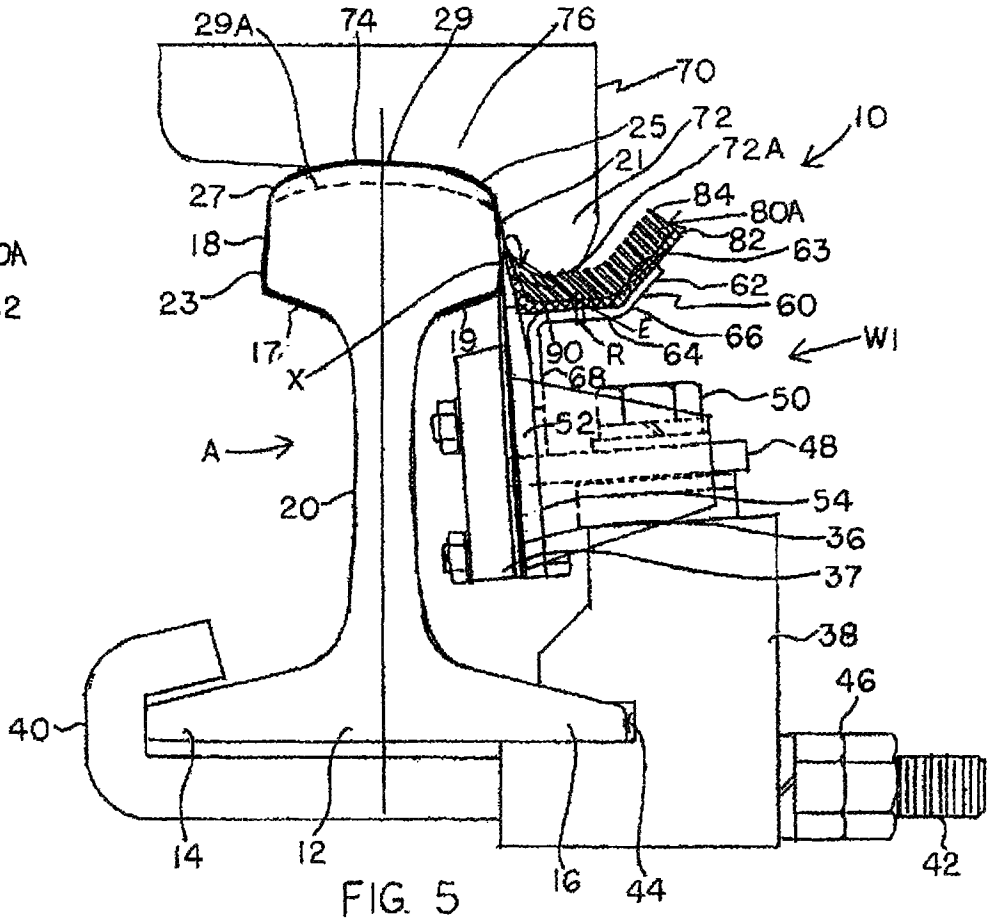
FIG. 5 is an end elevational view of a second embodiment of a trough and mat of an applicator bar coacting with a railroad rail made in accordance with the present invention.
Figure 6:
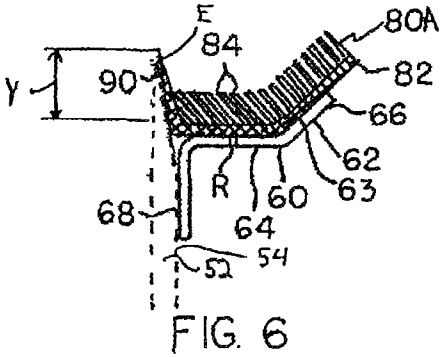
FIG. 6 is a side elevational view of the trough and mat of the applicator bar shown in FIG. 5.

FIGS. 5 and 6 show a second embodiment of a mat 80A similar to mat 80, except that mat 80A includes a flexible lip or flap 90 that may extend slightly above blade 52 (designated 90 as shown in FIG. 5) and may extend slightly below an end of the blade 52 (designated 90' as shown in FIG. 7). The flap 90 may vary in height (shown as arrow Y) with respect to the blade 52 as shown in phantom in FIG. 6. The flexible flap 90 can be made of rubber or another flexible material, such as a polymeric material. The flap 90, which is biased against the blade 52, may be integrally formed with the base 82 of the mat 84A or may be separately attached to the body 62 of the trough 60. When the flap 90 extends above the blade 52, the flap 90 preferably rests against the gage face 21 of the rail head 18 (shown in FIG. 5). In operation, lubricant passes through the blade 52 and between the gage face 21 and the flap 90. Excess material then flows onto an outside face of the flap 90 and into the trough 60 as designated by arrow A shown in FIG. 5. The mat 80A collects the lubricant material on the fingers 84 and redeposits the material back onto the wheel flange 72 as the train wheel 70 passes thereon. Because excess lubricant material is on an outside face of the flap 90, the lubricant material is redeposited on an inner portion of the wheel flange 72 thereby increasing the efficiency of lubricant transfer to the train wheels 70. When the flap 90' is positioned below an end of the blade 52 as shown in FIG. 7, the flap 90' acts as a seal thus preventing lubricant material from flowing down the outside face 54 of the blade 52 underneath a mat 81 and onto the trough 60 thereby wasting the lubricant material. Because of this shorter seal flap 90', excess lubricant flows back onto the mat 81.

FIG. 7 shows mat 81 made of a fibrous material. Referring to FIG. 7, the flap 90' may be attached to the first section 64 of the body 62 of the trough 60 using a rivet plate P, wherein an end of the flap 90' is sandwiched between the plate P and the body 62 of the trough 60. The plate P and the flap 90' may be secured to the trough 60 via mechanical fasteners such as rivets R. Alternatively, both flaps 90' and (90 shown in phantom in FIG. 7) may be used with mat 81. The two flaps 90 and 90', referred to as dual flaps, may be integrally formed from a unitary piece of elastomeric material, or each separately attached to the body 62 of the trough 60. The dual flap arrangement both prevents lubricant from flowing underneath the mat 81 and further increases the efficiency of lubricant transfer to the train wheels 70.

Figure 8:
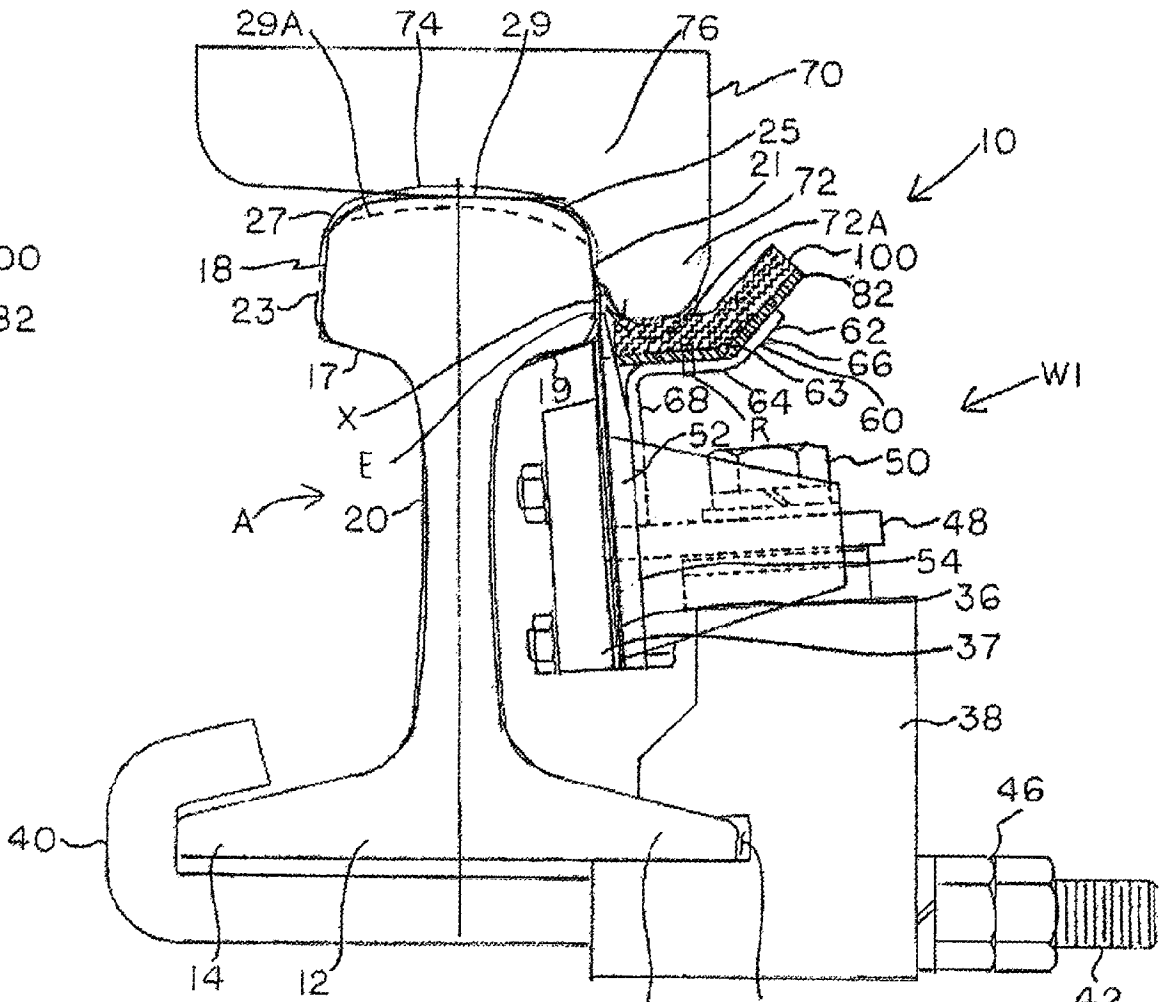
FIG. 8 is an end elevational view of a fourth embodiment of a trough and mat of an applicator bar coacting with a railroad rail made in accordance with the present invention.
Figure 9:
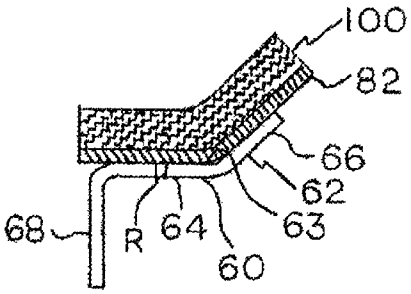
FIG. 9 is a side elevational view of the trough and mat of the applicator bar shown in FIG. 8.

FIGS. 8 and 9 show another embodiment of a mat 100 used on a wiping bar assembly W1 which is similar to the embodiment shown in FIGS. 2 and 3, except that mat 100 is made of a fibrous material such as felt, sponge or foam. The mat 100 may include a backing 82 as previously described. In operation, the fibrous material of the mat 100 absorbs the excess friction modifying material and redeposits the material back onto the wheel flange 72 as the train wheel 70 passes thereon.

Figure 10:
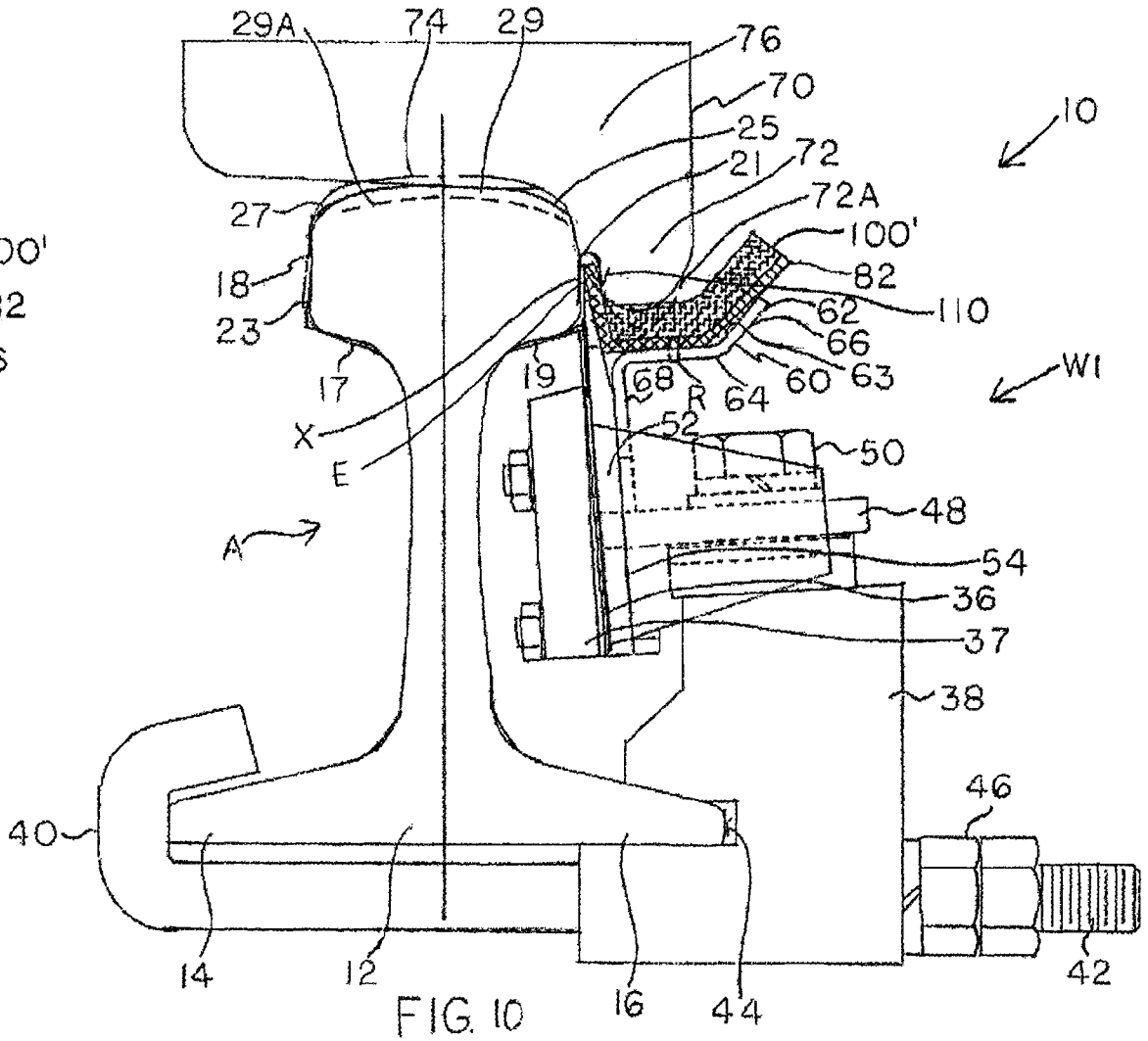
FIG. 10 is an end elevational view of a fifth embodiment of a trough and mat of an applicator bar coacting with a railroad rail made in accordance with the present invention.
Figure 11:
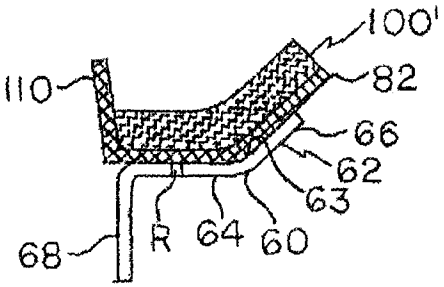
FIG. 11 is a side elevational view of the trough and mat of the applicator bar shown in FIG. 10.

FIGS. 10 and 11 show another embodiment of a mat 100' similar to mat 100, except that mat 100' includes a flap 110 that extends above blade 52 and preferably rests against the gage face 21 or the rail head 18. The flap 110 can be made of the same fibrous material as the mat 100' or another flexible material, such as a polymeric material. The flap 110 may be integrally formed with the base 82 or may be a separately attached piece. The mat 100' operates similar to the operation of mat 80A and hence will not be described in detail. Further, the seal flap 90' may be used in any of the embodiments discussed above in order to prevent excess lubricant material from flowing underneath the Mat 80, 80', 80A, 81, 100 or 100' and onto the trough 60, thereby wasting the lubricant material.

This invention has been described with reference to the preferred embodiments. Obvious modifications and alterations will occur to others upon reading and understanding the preceding detailed description. It is intended that the invention be construed as including all such modifications and alterations.

What is claimed is:

1. A trough and a wiping bar assembly of a rail lubrication system, said wiping bar assembly comprises a manifold body, a distribution blade adjacent a thin blade, said distribution blade and said thin blade coupled to said manifold body, and a flow passageway having an exit end at least partially defined in said manifold body and said distribution blade, said trough comprising a body having a first section and a second section extending away from said first section, said first section of said body positioned adjacent to said exit end, a mat provided within said trough, said mat comprising a base, said mat biased against said distribution blade and extending from said distribution blade to said second section, said mat collecting overflow lubricant material, said base to prevent said lubricant material from seeping through said mat, said first section and mat positioned at an angle less than or equal to 90 degrees from a plane of said manifold body so that any overflow lubricant material deposited on said mat flows towards said exit end for re-distribution.

2. The trough as claimed in claim 1, wherein a downwardly extending flange is attached to said first section of said body of said trough, and wherein said flange is adapted to attach to said wiping bar assembly.

3. The trough as claimed in claim 1, wherein said mat is made of a fibrous material.

4. The trough as claimed in claim 1, wherein said mat is made of a flexible material.

5. The trough as claimed in claim 1, wherein said mat comprises a base and a plurality of longitudinally extending fingers axially extending from said base, and wherein said fingers are adapted to coact with a wheel flange of a train.

6. The trough as claimed in claim 5, wherein said base and said fingers of said mat are made of a unitary piece of elastomeric material.

7. The trough as claimed in claim 5, wherein said base is made of a flat piece of elastomeric material.

8. The trough as claimed in claim 1, wherein the mat having a first end and a second end further defines an upwardly extending flap extending from said first end toward a head of a railroad rail adjacent the exit end, whereby said flap is adapted to coact with a portion of a side surface of a wheel flange of a train.

9. The trough as claimed in claim 8, wherein said flap and said base are integrally formed.

10. The trough as claimed in claim 1, wherein the mat having a first end and a second end further defines a seal flap extending from said first end toward the exit end, wherein said seal flap is positioned below the exit end and is biased against the wiping bar assembly, and wherein said seal flap acts as a seal to prevent excess lubricant material from flowing underneath said mat and onto said trough thereby wasting the lubricant material.

11. The trough as claimed in claim 10, wherein the mat having a first end and a second end further defines an upwardly extending flap extending from said first end toward a head of a railroad rail adjacent the exit end, whereby said flap is adapted to coact with a portion of a side surface of a wheel flange of a train.

12. The trough as claimed in claim 11, wherein said seal flap and said flap are integrally formed.

13. A rail lubrication distribution system comprising:

a first railroad rail;

a second railroad rail spaced apart from said first railroad rail;

a first wiping bar assembly affixed to said first railroad rail;

a second wiping bar assembly affixed to said second railroad rail; and a flow divider in fluid communication with said first wiping bar assembly and said second wiping bar assembly, wherein each of said wiping bar assemblies comprises said trough and wiping bar assembly of claim 1.

14. A method of increasing the efficiency of lubricant transfer to a gage face surface of a rail head using a wiping bar assembly of a rail lubrication system, the method comprising the steps of:

providing said trough and wiping bar assembly of claim 1 for depositing lubricant material to said gage face surface of said rail head;

supplying lubricant material to said gage face surface of said rail head via said trough and wiping bar assembly, wherein excess lubricant material then flows onto said mat provided within said trough; and redepositing said excess lubricant material onto said gage face surface of said rail head.

15. The trough as claimed in claim 1, wherein said mat comprises a first material and a second material.

16. The trough as claimed in claim 1, wherein said mat is made of a foam material.

17. An applicator bar for applying lubricant material to a head of a rail, comprising:

a manifold body;

a distribution blade adjacent a thin blade, said distribution blade and said thin blade coupled to said manifold body;

a flow passageway at least partially defined in said manifold body and said distribution blade for said lubricant material to flow through, said flow passageway defining an exit end; and a trough coacting with said distribution blade, said trough comprising a body having a first section and a second section extending away from said first section, said first section of said body positioned adjacent to said exit end for catching overflow of said lubricant material, a mat provided within said trough, said mat comprising a base, said mat biased against said distribution blade and extending from the distribution blade to the second section, said mat collecting overflow of said lubricant material, said base to prevent said lubricant material from seeping through said mat, said first section and mat positioned at an angle less than or equal to 90 degrees from a plane of said manifold body so that any overflow lubricant material deposited on said mat flows towards said exit end for re-distribution.

18. The applicator bar as claimed in claim 17, wherein said exit end is partially defined by said distribution blade for directing said lubricant material to a surface of said rail.

19. The applicator bar as claimed in claim 17, wherein said mat is made of a fibrous material.

20. The applicator bar as claimed in claim 17, wherein said mat is made of a flexible material.

21. The applicator bar as claimed in claim 17, wherein said mat is made of a resilient polymeric material comprising a plurality of non-uniform loops intertwined together thereby forming voids therein adapted to absorb lubricant material.

22. The applicator bar as claimed in claim 17, wherein said mat is secured to said trough via a fastener passing through said mat and said trough and secured thereto.

23. The applicator bar as claimed in claim 17, wherein said mat has a first end and a second end such that said first end of said mat is positioned adjacent said first section of said trough and said second end of said mat is positioned adjacent said second section of said trough.

24. The applicator bar as claimed in claim 23, wherein said mat is made of a foam material.

25. The applicator bar as claimed in claim 23, wherein at least a portion of said mat is angled relative to a horizontal axis.

26. The applicator bar as claimed in claim 25, wherein a portion of said mat extends above said second section of said trough.

27. The applicator bar as claimed in claim 23, wherein a portion of said mat extends above said second section of said trough.

28. The applicator bar as claimed in claim 23, wherein said mat is made of polymeric material, vinyl, rubber and/or sponge.

* * * * *

UNITED STATES PATENT AND TRADEMARK OFFICE

CERTIFICATE OF CORRECTION

PATENT NO. : 9,022,173 B2
APPLICATION NO. : 13/935019
DATED : May 5, 2015
INVENTOR(S) : Singleton et al.

It is certified that error appears in the above-identified patent and that said Letters Patent is hereby corrected as shown below:

On the title page

Item [71], delete "L.B. Foster Rail Technologies, Inc., Burnaby (CA)" insert --L.B. Foster Rail Technologies, Inc., Pittsburgh, PA (US)--.

Signed and Sealed this
Fifteenth Day of September, 2015

Michelle K. Lee

Michelle K. Lee
*Director of the United States Patent and Trademark Office*